US006136152A

United States Patent [19]

Begemann

[11] Patent Number: 6,136,152

[45] Date of Patent: Oct. 24, 2000

[54] PROCESS AND DEVICE FOR CONTROLLING THE CONSISTENCY AND FIBER ORIENTATION PROFILE IN A HEADBOX

[75] Inventor: Ulrich Begemann, Heidenheim, Germany

[73] Assignee: Voith Sulzer Papiermaschinen GmbH, Heidenheim, Germany

[21] Appl. No.: 08/921,022

[22] Filed: Aug. 29, 1997

[30] Foreign Application Priority Data

Aug. 30, 1996 [DE] Germany ..... 196 34 993

[51] Int. Cl.[7] ..... D21F 1/02

[52] U.S. Cl. ..... 162/336; 162/264; 162/338; 162/343

[58] Field of Search ..... 162/336, 264, 162/338, 343, 380, DIG. 11, 258

[56] References Cited

U.S. PATENT DOCUMENTS

| | | | |
|---|---|---|---|
| 3,002,558 | 10/1961 | Meyer . | |
| 3,328,236 | 6/1967 | Burgess, Jr. et al. . | |
| 4,469,556 | 9/1984 | Sanford . | |
| 5,196,091 | 3/1993 | Hergert . | |
| 5,549,792 | 8/1996 | Begemann . | |
| 5,626,722 | 5/1997 | Huovila | 162/343 |
| 5,695,611 | 12/1997 | Bubik et al. . | |

OTHER PUBLICATIONS

Copy of a German Search Report dated Feb. 18, 1997 with German Application No. 196 34 993.1.

English Language Translation of European Patent Application No. 95 105 978.1.

Copy of a European Search Report dated Feb. 13, 1998 and Annex.

*Primary Examiner*—Peter Chin

*Attorney, Agent, or Firm*—Greenblum & Bernstein, P.L.C.

[57] ABSTRACT

A headbox for a paper machine and a process for controlling consistency of the slurry. The headbox includes a turbulence insert having an inlet end and a distributing pipe having a connecting area. The distributing pipe may extend across a width of the paper machine for feeding a slurry flow through the connecting area and into the turbulence insert. The headbox may also include a nozzle having an outlet gap and a plurality of feed lines supplying control flows. The plurality of feed lines may be coupled to the connecting area at an angle α between approximately 5° and 170° with respect to a directional component of the slurry flow directed toward the turbulence insert, the plurality of feed lines may be positioned in a vicinity of the inlet end. The headbox may further include a device for adjusting the control flows, whereby a consistency of the slurry flow may be adjusted in the vicinity of the inlet end by adjusting the control flows, while a constant volumetric flow of the slurry flow is maintained in the vicinity of the inlet end. The process includes feeding a slurry flow to the headbox across a width of the machine, distributing a plurality of control flows across the width, maintaining a constant rate volumetric flow of the slurry flow, and injecting the plurality of control flows in a vicinity of the turbulence insert at an angle α, between approximately 5° and 170°, with respect to a flow component of the slurry flow directed toward the turbulence insert. In this manner, the plurality of control flows may be diverted less than approximately 180° in the distributing pipe to include a flow direction substantially parallel to the slurry flow.

20 Claims, 3 Drawing Sheets

PROCESS AND DEVICE FOR CONTROLLING THE CONSISTENCY AND FIBER ORIENTATION PROFILE IN A HEADBOX

CROSS-REFERENCE TO RELATED APPLICATION

The present application claims priority under 35 U.S.C. § 119 of German Patent Application No. 196 34 993.1 filed Aug. 30, 1996, the disclosure of which is expressly incorporated by reference herein in its entirety.

BACKGROUND OF THE INVENTION

1. Field of the Invention

The present invention relates to a headbox for a paper machine that includes a turbulence insert, a distributing pipe extending across a machine width for feeding a slurry flow into the turbulence insert, a nozzle having an outlet gap, and a plurality of feed lines for supplying a control flow. The plurality of feed lines, in a connecting area of the distributing pipe, may be provided in a vicinity of the turbulence insert at an angle $\alpha$, e.g., between approximately 5° and 170°, relative to a direction of the slurry flow toward the turbulence insert. In this manner, the consistency of the slurry flow can be adjusted to a desired value at an input area of the turbulence insert by control flows injected via the plurality of feed lines, while maintaining a constant volumetric slurry flow in the input area.

The present invention also relates to a process for controlling the consistency and fiber orientation cross-sectional profile in a headbox. The process may include feeding a slurry flow to the headbox across an overall machine width, controlling the consistency profile of the slurry flow via a plurality of control flows distributed across the machine width, while maintaining a volumetric flow of the slurry flow at a constant rate. The process may include injecting the control flows into the distributing pipe, at an angle $\alpha$, e.g., between approximately 5° and 170°, to a direction of the slurry flow toward the turbulence insert. In this area, i.e., immediately before the turbulence insert, the slurry flow may substantially include only a flow component in the direction of the turbulence insert. Further, the process may include diverting the injected control flows in the distributing pipe at an angle less than approximately 180° to have a flow direction parallel to the slurry flow.

2. Discussion of Background Information

Consistency-controlled headboxes for adjusting or controlling the consistency and fiber orientation cross-sectional profile are known in the prior art. These devices generally utilize two different concepts. A first concept, according to U.S. Pat. No. 5,196,091, shows a headbox provided with a pulp slurry via a distributing pipe extending across the entire machine width. The distributing pipe in this device cannot be sectioned. Connected to the distributing pipe is a machine-wide turbulence insert which has a plurality of evenly arranged columns and rows of turbulence pipes.

Between the evenly arranged turbulence pipes, feed lines are arranged parallel to the pipes for adding a diluting medium which can be water or diluted pulp slurry.

To control the consistency profile across the machine width, a corresponding amount of diluting medium is injected via the diluting medium feed lines, however, the amount depends on the value of the desired consistency in the turbulence section. In this case, the diluting or control flow emerging from the distributing pipe is directed opposite the slurry flow entering the turbulence pipe.

Thus, dilution occurs as the control flow is diverted 180° by the slurry flow. While the slurry flow may be slow in the distributing pipe, the control flow is diverted to flow along the width of the machine together with the slurry flow. The diluted slurry flow is fed into an inlet side of a turbulence pipe of the turbulence insert. In this manner, the slurry flow is controlled while the volume flow is maintained at a constant level and not by the feed rate into the distribution pipe.

The disadvantage of headboxes according to the above-noted first concept is that, due to the very small diameters of the diluting pipes, the outlet speed of the diluting media or control flows within the distributing pipe is very high. This causes a relatively large transverse effect on the control flow, which allows for only a very rough setting of the consistency in individual sections of the headbox. Moreover, thin pipes of the type utilized in the prior art only allow the dosing of very small quantities. Thus, the range in which the consistency can be controlled, which is relative to the specified mean consistency of the slurry flow entering the distributing pipe, is very small.

A second concept of a consistency-controlling headbox is disclosed, e.g., in DE 40 19 593. According to DE 40 19 593, the slurry flow, which is fed by a common distributing pipe, is sectioned, i.e., subdivided across a width of the headbox into independent partial flows, i.e., so-called "sectional flows." This sectioning occurs, e.g., by subdividing the width of the headbox into sections via partition walls.

The setting of the consistency then occurs by feeding the control flow in the individual sections of control flow into a mixer. Connected to the mixer, a turbulence insert is coupled and associated with the individual sections. Further, in the concept in accordance to DE 40 19 593, the consistency of the corresponding sectional flows is set, e.g., while the volumetric flow of the sectional flow is maintained at a constant rate.

The system of DE 40 19 593 utilizes a sectioned headbox, which is known from DE 43 23 263. In this manner, the control flow is injected into the individual sections at angles between 5° and 90° in the direction of the main flow.

Further, a control method has been discussed, e.g., in DE 42 39 845, in which the consistency and fiber orientation profile can be controlled depending on the specifics of the sheet making process.

The disadvantage with headboxes constructed in accordance with the second concept is that the setting of a consistency and fiber orientation cross-sectional profile always preconditions that the slurry flow is divided into partial flows to be correspondingly controlled in the adjoining mixer for the individual sections.

This disadvantage results in high design expenditure. Further, due to the size of the device, the configuration commands high space expenditure.

SUMMARY OF THE INVENTION

In view of the foregoing, the present invention is directed to a headbox which avoids the disadvantageous configurations of the prior art.

The present invention provides a headbox that enables an adequately accurate control of the consistency of the cross-sectional profile without sectioning the slurry flow injected into the headbox. In particular, the transverse effect may be improved, i.e. minimized, with respect to the devices of the prior art, e.g., U.S. Pat. No. 5,196,091. Further, the present invention provides a process for controlling the consistency and the weight per unit area cross-sectional profile. The process of the present invention avoids partial flows and yet maintains an adequately small transverse effect.

According to the present invention, a plurality of feed lines for the control flows discharge directly into the distributing pipe, e.g., as in U.S. Pat. No. 5,196,091. The feed lines may be positioned immediately in front of the inlet end of the turbulence insert in an area in which the slurry flow has only one flow component, i.e., in the direction toward the turbulence insert. Generally, the individual feed lines are arranged, e.g., in series in a direction of the machine width. The angles, by which the feed lines for the control flow may be injected into the distributing pipe, may be between approximately 50 and 170° to the direction of the slurry flow which enters the turbulence insert. However, it is preferred that the injecting occur at substantially a right angle to the slurry flow.

The process of the present invention may also provide that the control flows are returned, immediately before entry of the slurry flow into the turbulence insert, substantially at right angles. In particular, if the control flow rate is selected in this way, it is preferred that a flow component, which is located in a direction of injection and across the direction of slurry flow, be located even at the turbulence pipe of the turbulence insert which is farthest away from the injection opening.

The present invention is directed to a headbox for a paper machine that may include a turbulence insert having an inlet end and a distributing pipe having a connecting area. The distributing pipe may extend across a width of the paper machine for feeding a slurry flow through the connecting area and into the turbulence insert. The headbox may also include a nozzle having an outlet gap and a plurality of feed lines supplying control flows. The plurality of feed lines may be coupled to the connecting area at an angle $\alpha$ between approximately 5° and 170° with respect to a directional component of the slurry flow directed toward the turbulence insert, the plurality of feed lines may be positioned in a vicinity of the inlet end. The headbox may further include a device for adjusting the control flows, whereby a consistency of the slurry flow may be adjusted in the vicinity of the inlet end by adjusting the control flows, while a constant volumetric flow of the slurry flow is maintained in the vicinity of the inlet end.

According to another feature of the present invention, the angle $\alpha$ may be between approximately 85° and 95°. Further, angle $\alpha$ may be approximately 90°.

According to another feature of the present invention, the plurality of feed lines may be positioned at an angle $\gamma$ between approximately 5° and 90° with respect to the direction of the slurry flow into the turbulence insert and within a plane substantially parallel to a plane formed by the inlet end of the turbulence insert. Further, the angle $\gamma$ may be less than approximately 90°. Still further, the plurality of feed lines may be adjustably positionable to the angle $\gamma$.

According to still another feature of the present invention, the distributing pipe may have guides for diverting the slurry flow in the direction of the turbulence insert. Further, the guides may be adjustably positionable.

According to a further feature of the present invention, the turbulence insert may include a plurality of turbulence pipes.

The present invention may be directed to a process for controlling at least one of consistency and fiber orientation profile in a headbox of a machine. The process may include feeding a slurry flow to the headbox across a width of the machine, distributing a plurality of control flows across the width, maintaining a constant rate volumetric flow of the slurry flow, and injecting the plurality of control flows in a vicinity of the turbulence insert at an angle $\alpha$, between approximately 5° and 170°, with respect to a flow component of the slurry flow directed toward the turbulence insert. In this manner, the plurality of control flows may be diverted less than approximately 180° in the distributing pipe to include a flow direction substantially parallel to the slurry flow.

According to another feature of the present invention, the angle $\alpha$ may be between approximately 85° and 95°.

According to another feature of the present invention, the injecting may include injecting the plurality of control flows substantially perpendicular to the flow component of the slurry flow.

According to still another feature of the present invention, the injecting may further include regulating a flow rate of the plurality of control flows relative to the slurry flow rate. In this manner, the plurality of control flows may include flow components in a direction of injection and lateral to the flow component of the slurry flow. Further, the lateral flow component of the plurality of control flows may extend to a lowermost turbulence pipe positioned in a direction substantially parallel to the injection direction from an inlet feeding the plurality of control flows.

The present invention may also be directed to a headbox for a machine that includes a distributing pipe extending along a width of the machine for distributing a slurry flow, a turbulence insert having an inlet end coupled to the distributing pipe, and at least one feed line coupled to the distributing pipe. The at least one feed line may be positionable at an angle less than approximately 180° with respect to a flow direction of the slurry toward the turbulence insert.

According to another feature of the present invention, the at least one feed line may be positionable at an angle less than or equal to approximately 90° with respect to a flow direction of the slurry through the distribution pipe. Further, an adjustment device may adjustably position the at least one positionable feed line to an angular position relative to the flow direction of the slurry toward the turbulence insert and the flow direction of the slurry through the distributing pipe. Still further, the headbox may include a regulating device coupled to the at least one positionable feed line for adjusting a flow rate through the at least one positionable feed line.

According to a still further feature of the present invention, the turbulence insert may include a plurality of turbulence pipes arranged in a plurality of rows and columns.

According to still another feature of the present invention, the turbulence insert may include a plurality of turbulence recesses arranged as columns, each turbulence recess including a plurality of turbulence pipes.

According to a further feature of the present invention, an adjustment device may adjust the at least one positionable feed line.

According to still another feature of the present invention, the turbulence insert may include a plurality of adjustable guide walls for diverting the slurry flow toward the turbulence insert.

The present invention may also be directed to a process for adjusting a consistency of a slurry flow in a headbox for a machine having a turbulence insert. The process may include guiding a slurry flow lateral to a turbulence insert, diverting a portion of the slurry flow toward the turbulence insert, injecting a control flow at an angle less than approximately 180° with respect to the slurry flow toward the turbulence insert, and guiding the slurry flow and the control flow through the turbulence insert.

According to another feature of the present invention, the injecting may include directing the control flow at an angle less than or equal to approximately 90° with respect to the slurry flow lateral to the turbulence insert. Further, the injecting may further include injecting and directing the control flow in a direction opposite the slurry flow.

According to still another feature of the present invention, the injecting and directing may further include regulating an injection rate for the control flow. In this manner, the control flow may be guided through each turbulence pipe in the turbulence insert.

According to yet another feature of the present invention, the injecting may include regulating an injection rate for the control flow. In this manner, the control flow may be guided through each turbulence pipe in the turbulence insert.

Other exemplary embodiments and advantages of the present invention may be ascertained by reviewing the present disclosure and the accompanying drawing figures.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
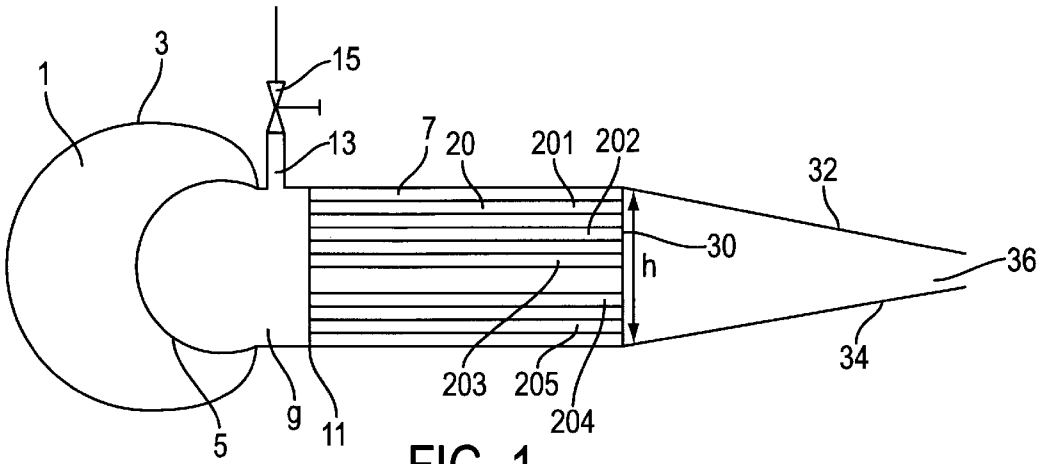
FIG. 1 illustrates a sectional view through a headbox in a longitudinal direction of the machine.

FIG. 1 illustrates a longitudinal section through a headbox in accordance with the present invention. A pulp slurry is fed through a distributing pipe 1 across an entire width of a machine, e.g., a paper making machine. Distributing pipe 1 may be provided with a inlet side 3 having a large diameter (with respect to an outlet end 5) and with an outlet side 5 having a smaller diameter 5. Distributing pipe 1 may include a connecting area 9 that is directly coupled with a turbulence insert 7. Connecting area 9 may include an end 11 coupled to the inlet flow side of turbulence insert 7. Feed lines (or control flow feed lines) 13 may be provided to insert control flows into the pulp slurry fed through distributing pipe 1 into turbulence insert 7. To control the control flows fed via feed line 13 to the slurry flow, control valves 15 may be associated with each feed line 13, and may be composed of controlling or regulating valves, e.g., as disclosed in DE 42 39 845. Turbulence insert 7 may include a plurality of turbulence pipes 20 distributed along a width of the machine, and further, turbulence pipes 201–205 may be arranged in as a column having a height h in a recess formed within turbulence insert 7.

Upon exiting an end 30 on an outlet side of turbulence insert 7, the pulp flows through adjustable orifices 32 and 34 and ultimately through an outlet 36.

Figure 2:
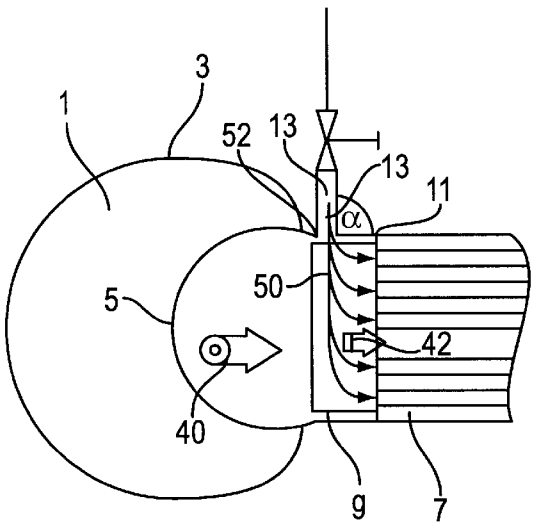
FIG. 2 illustrates an enlarged view of an area in which control flows are added to a slurry flow.

In FIG. 2, an enlarged sectional view illustrates an inlet area of headbox according to the present invention, and the prevailing flow conditions. The slurry may be fed through distributing pipe 1, e.g., in a direction perpendicular to the figure and in a direction as indicated by arrow 40, i.e., in the direction of the machine width. Thus, within distributing pipe 1, a diversion of the slurry flow may occur as indicated by arrow 40, i.e., in a direction lateral to the machine, e.g., towards an end 11 on the inlet side of turbulence insert 7. A flow effect, as indicated by arrow 42, in the direction toward turbulence insert 7, may occur within connecting area 9 which adjoins or is adjacent distributing pipe 1.

A control flow 50 may be injected, via feed line 13, into connecting area 9 of distributing pipe 1. Control flow 50 may be injected at an angle $\alpha$, which, for the purposes of this explanation may be approximately 90°. However, in accordance with the features of the present invention, angle $\alpha$ may be any angle less than approximately 180°. Control flow 50 may be injected at an adequately high rate so that control flow 50 may also include a component substantially perpendicular to the direction of slurry flow 42 at a position at the end of distributing pipe 1, i.e., opposite a feed inlet 52. However, it is noted that only the control flow 50 component that is substantially parallel to the direction of slurry flow 42, i.e., directed toward end 11 of turbulence insert 7, is utilized to control consistency of the pulp slurry. Accordingly, control flow 50 should be diverted in some manner to control pulp consistency. However, contrary to U.S. Pat. No. 5,196,091, it is not necessary to divert the control flow by 180° to produce a component parallel to slurry flow 42. A diversion corresponding to a constant injection angle $\alpha$, e.g., less than approximately 180° is adequate. Further, to ensure that the system may be adaptable to various conditions and materials, the headbox may include a device for variably controlling angle $\alpha$ for one, some, or all feed lines 13.

A diversion of the flow direction of less than approximately 180° has numerous advantages over the prior art as disclosed in U.S. Pat. No. 5,196,091. Moreover, the size of the feed inlet may be any desired dimension, and is not merely limited to a size defined by the area surrounding the feed inlet, as in the above referenced U.S. patent. A larger feed inlet enables injection of regulating flows having a lower rate and, therefore, higher consistency. In this manner, a more extensive variation range $\Delta\rho_0$ for controlling consistency by a mean, fed consistency value $\rho_0$. This allows the consistency to be adjusted across the width of the headbox at least in a range of:

$$\rho_0-\Delta\rho_0 \leq \rho(d) \leq \rho_0+\Delta\rho.$$

Another advantage associated with a lower injection rate and a diversion of the control flow of less than approximately 180° is that the transverse effect of the injected control flow may be smaller than that available in the above referenced U.S. Pat. No. 5,196,091. This arrangement has the advantage that the consistency, which is relatively clearly defined in the area under consideration, i.e., in a vicinity of an inlet to a turbulence tube, may be precisely controlled without the controlling effect overlapping into adjacent areas, which, generally, can only be influenced with a very high degree of difficulty.

Figure 3:
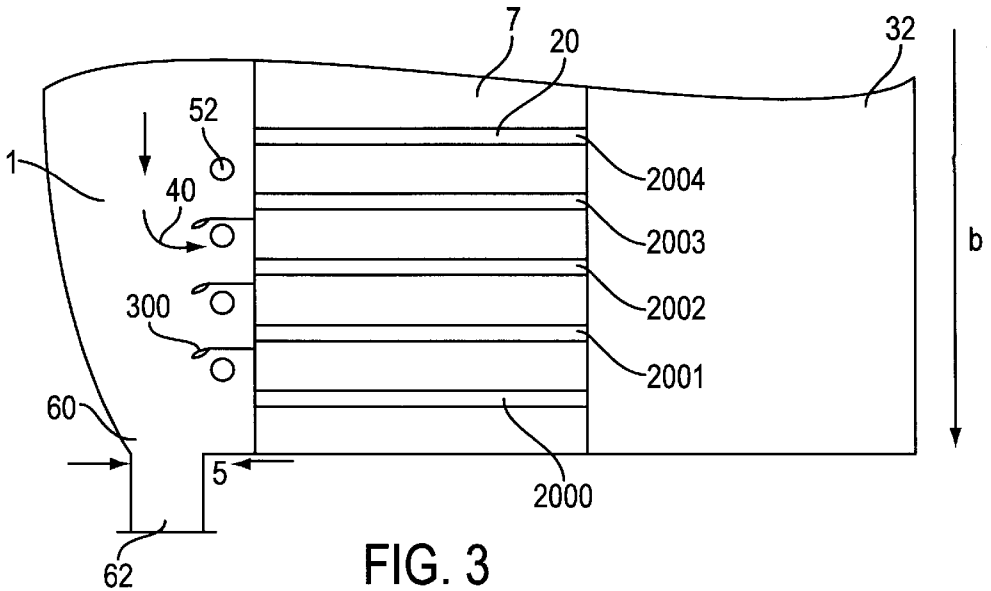
FIG. 3 illustrates a top view of the headbox depicted in FIG. 1 in the longitudinal direction of the machine.

FIG. 3 illustrates a top view of the headbox depicted in FIG. 1. However, only a partial view of the entire machine width b is shown. As discussed with regard to FIG. 1, distributing pipe 1 may extend across or along the entire machine width b with a slurry flow in a direction from inlet side 3 to an end 60 of outlet side 5. It is again noted that distributing pipe 1 tapers along its length from inlet side 3 to outlet side 5, i.e., the cross section of inlet side 3 is larger than the cross section of outlet side 5, and the cross-section of outlet side 5 is larger than the cross-section of end 60. At outlet end 60, an outlet connection 62 may be located, through which, a portion of the slurry flow that is not diverted in the direction of turbulence insert 7, i.e., as indicated by the arrow 40, may be carried off. To support the diversion of slurry flow 40 in distributing pipe 1, i.e., directly in front of turbulence insert 7, in the direction toward turbulence insert 7, adjustable guide walls 300 may be placed within distributing pipe 1. Guide walls 300 may be arranged such that no congestion occurs in the slurry flow. Inlet opening 52 of supply pipes 13 provide control flows 50 of diluting medium into distributing pipe 1, and control flows 50 may be positioned in series directly in front turbulence insert 7 and across the machine width b of the headbox. Turbulence insert 7 may include adjacent, i.e., parallel-coupled bundles of pipes, or pipe recesses of turbulence pipes 20. In the embodiment depicted in FIG. 3, a total of five adjacent turbulence pipes 2000, 2001, 2002, 2003 and 2004 are shown. Adjustable orifice 32, as discussed above, may further be coupled to turbulence insert 7 across the entire width of the machine.

Figure 4:
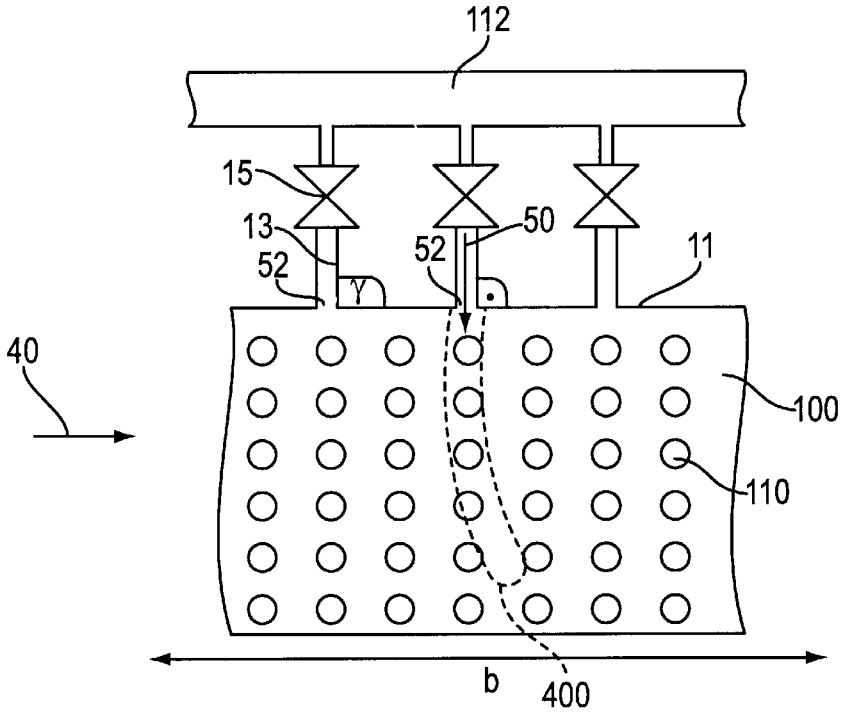
FIG. 4 illustrates an inlet side of the turbulence section having feed lines and control flows extending across the width of the machine.

FIG. 4 illustrates a view of inlet end 11 of turbulence insert 7 from within distribution pipe 1. Turbulence insert 7 may include an orifice plate 100 that includes openings 110 arranged in columns and rows. Turbulence pipes 20 may be coupled to openings 110. In the illustrated embodiment, the pipes may be arranged in rows that extend across the entire machine width b and in columns that include, e.g., six rows of adjacent turbulence pipes. Feed inlets 52 and feed lines 13 inserting control flow 50 may be placed upon an upper end of distributing pipe 1 (not shown) to direct control flows 50 in front of orifice plate 100. A control valve 15 may be associated with each feed line 13, and each feed line may be coupled to a common control flow feed line 112 to provide a diluting medium, e.g., diluted pulp slurry or water.

Control flow feed lines 13, as illustrated in FIG. 4, may be positioned atop a column of turbulence pipes or turbulence pipe recesses at an angle γ. Angle γ is to be considered with respect to the horizontal and within a plane substantially parallel to orifice plate 100. The angle γ in the embodiment illustrated in FIG. 4 may be substantially a right angle or approximately 90°. At a lower injection speed, the transverse effects of control flows 50 may be limited to the speed of the slurry flow, and at a maximum speed, the transverse effects may be limited to the adjacent pipe recesses. In this manner, an exact sectional control of the consistency may be possible across the entire width b of the machine. Thus, overlaps or interferences may, to a large extent, be substantially avoided. An exemplary transverse effect in the arrangement of FIG. 4 may be illustrated by control flow cloud 400. Control cloud 400 may be formed by injecting control flow 50 through opening 52 and into main slurry flow 40 through distribution pipe 1. As shown in FIG. 4, as control flow 50 travels farther into main slurry flow 40, control flow cloud 400 begins to divert or drift in the direction of main slurry 40. In this manner, control flow 50 may be inserted atop one column of turbulence pipes or recesses and reach turbulence pipes or recesses in an adjacent, i.e., downstream, column.

Figure 5:
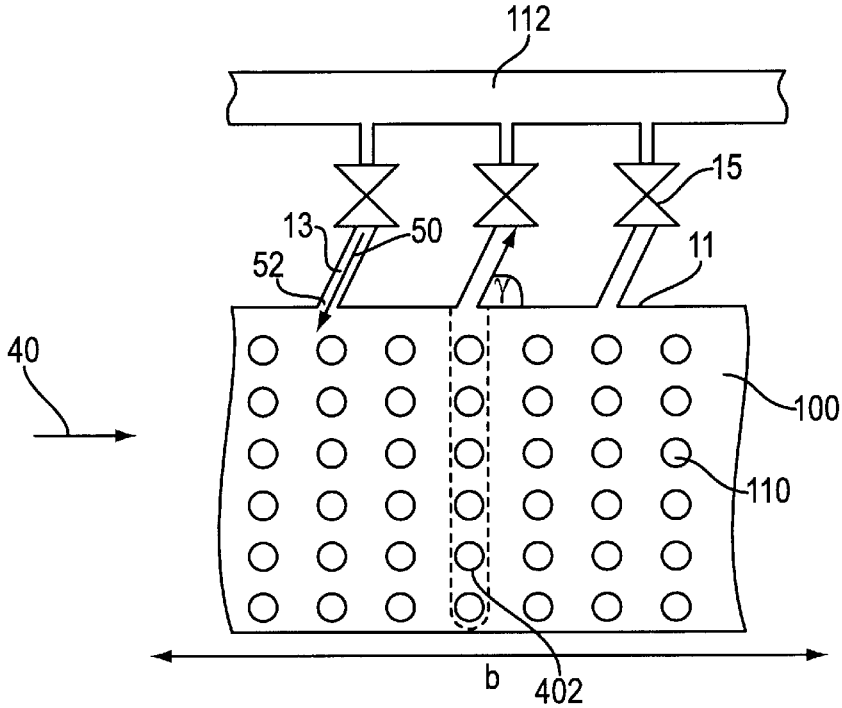
FIG. 5 illustrates an alternative to the embodiment depicted in FIG. 4.

The cross-flow or transverse effect may be avoided in accordance with the arrangement illustrated in FIG. 5. According to FIG. 5, feed lines 13 for injecting control flows 50 may be positioned at an angle of γ, where angle γ may be, e.g., less than approximately 90°, with respect to the horizontal, and within the plane substantially parallel to orifice plate 100.

By injecting control flow 50 at an angle γ of less than approximately 90° with respect to the horizontal, control flows 50 may include a component in direction opposite the pulp slurry 40 moving transverse to orifice plate 100. Thus, a diversion of control flow 50 by slurry flow 40 may be either reduced or substantially avoided with an appropriate selection of angle γ. For example, a transverse effect 402 of control flow 50 may be limited to one pipe recess.

In a further embodiment of the present invention, the headbox may include a device that automatically or manually changes or adjusts the slope or angle γ of feed lines 13.

Figure 6:
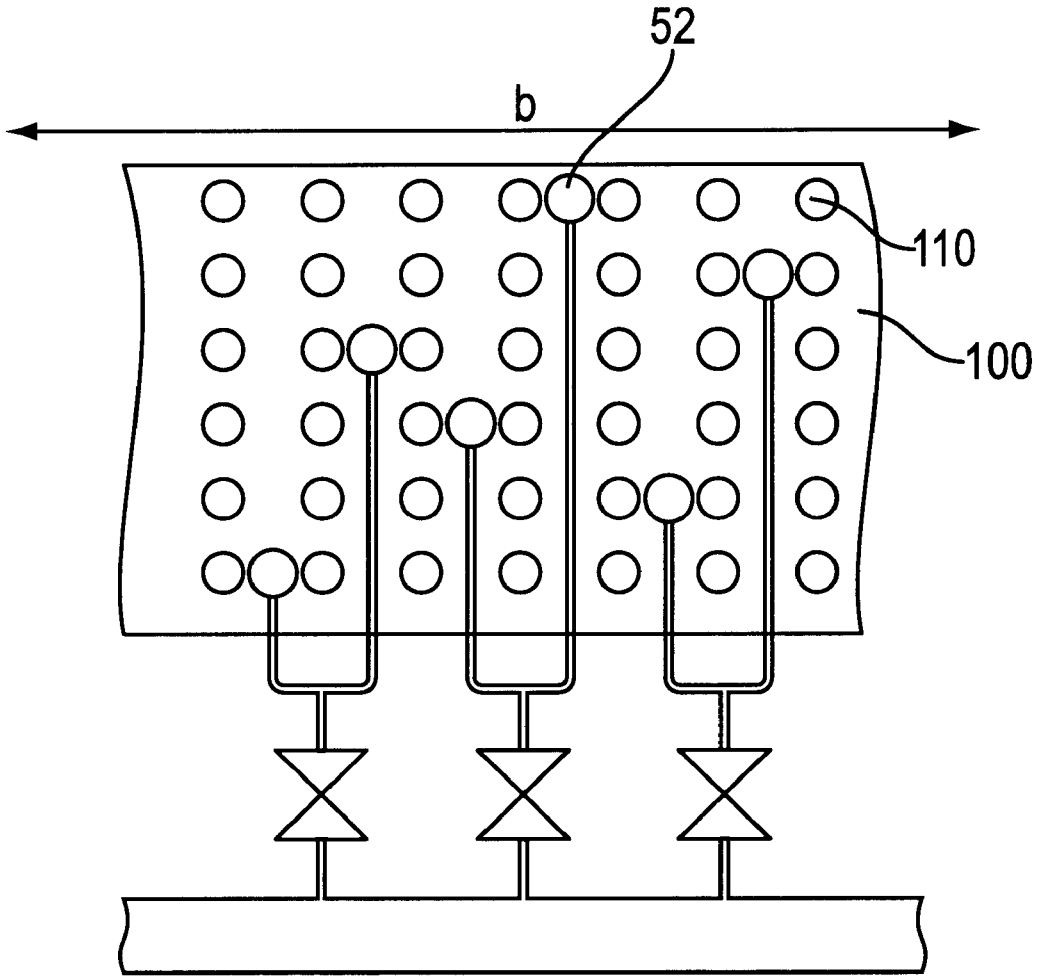
FIG. 6 (PRIOR ART)
FIG. 6 illustrates the inlet side in accordance with the prior art.

The injection of control flow according to the prior art of U.S. Pat. No. 5,196,091 is illustrated in FIG. 6. FIG. 6 shows a view of an orifice or closing plate 100 with holes 110 of a turbulence insert of a distributing pipe that extends across the entire width of the machine. In contrast to the present invention, the control flow feed lines are arranged parallel to the turbulence pipes, and the inlet openings 52 for the feed lines are provided adjacent to the openings 110 of the turbulence pipes. This specific arrangement limits the available size for the inlet openings 110 to the distance between the recesses of turbulence pipes. However, in accordance with the present invention, as depicted in FIG. 4, the inlet openings may be formed to be significantly larger than those of the prior art. Another disadvantage of the configuration according to the prior art, as shown in FIG. 6, is that at least a diversion of the control flow of 180° must occur in order to control the consistency in the fed slurry flow. Thus, in accordance with the present invention, the device and process may achieve a very exact consistency and fiber orientation profile control in a headbox with a very compact design with a diversion of the direction of the control flow of less than approximately 180°.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A headbox for a paper machine comprising:

a turbulence insert having an inlet end;

a distributing pipe having a connecting area, the distributing pipe extending across a width of the paper machine for feeding a slurry flow through the connecting area and into the turbulence insert;

a nozzle having an outlet gap;

a plurality of feed lines supplying control flows;

the plurality of feed lines being coupled to the connecting area at an angle $\alpha$ between approximately 5° and 170° with respect to a directional component of the slurry flow directed toward the turbulence insert, the plurality of feed lines being positioned in a vicinity of the inlet end;

a device for adjusting the control flows, whereby a consistency of the slurry flow is adjusted in the vicinity of the inlet end by adjusting the control flows, while a constant volumetric flow of the slurry flow is maintained in the vicinity of the inlet end;

the plurality of feed lines being positioned at an angle $\gamma$ between approximately 5° and less than approximately 90° with respect to the direction of the slurry flow into the turbulence insert and within a plane substantially parallel to a plane formed by the inlet end of the turbulence insert.

2. The headbox of claim 1, the angle $\alpha$ being between approximately 85° and 95°.

3. The headbox of claim 2, the angle $\alpha$ being approximately 90°.

4. The headbox of claim 1, the distributing pipe further having guides for diverting the slurry flow in the direction of the turbulence insert.

5. The headbox of claim 4, the guides being adjustably positionable.

6. The headbox of claim 1, the turbulence insert comprising a plurality of turbulence pipes.

7. A process for controlling at least one of consistency and fiber orientation profile in a headbox of a machine, the process comprising:

feeding a slurry flow to the headbox across a width of the machine;

distributing a plurality of control flows across the width via a plurality of feed lines;

maintaining a constant rate volumetric flow of the slurry flow; and injecting the plurality of control flows in a vicinity of a turbulence insert at an angle $\alpha$, between approximately 5° and 170°, with respect to a flow component of the slurry flow directed toward the turbulence insert, whereby the plurality of control flows are diverted less than approximately 180° in the distributing pipe to include a flow direction substantially parallel to the slurry flow, the plurality of feed lines being positioned at an angle $\gamma$ between approximately 5° and less than 90° with respect to the direction of the slurry flow into the turbulence insert and within a plane substantially parallel to a plane formed by the inlet end of the turbulence insert.

8. The process of claim 7, wherein the angle $\alpha$ is between approximately 85° and 95°.

9. The process of claim 7, the injecting comprising injecting the plurality of control flows substantially perpendicular to the flow component of the slurry flow.

10. The process of claim 7, the injecting further comprising regulating a flow rate of the plurality of control flows relative to the slurry flow rate, whereby the plurality of control flows include flow components in a direction of injection and lateral to the flow component of the slurry flow.

11. The process of claim 10, wherein the lateral flow component of the plurality of control flows extends to a lowermost turbulence pipe from an inlet feeding the plurality of control flows.

12. A headbox for a machine comprising:

a distributing pipe extending along a width of the machine for distributing a slurry flow;

a turbulence insert having an inlet end coupled to the distributing pipe;

at least one feed line coupled to the distributing pipe; and the at least one feed line positionable at an angle less than approximately 180° with respect to a flow direction of the slurry toward the turbulence insert;

the at least one feed line further positionable at an angle less than or equal to approximately 90° with respect to a flow direction of the slurry through the distribution pipe; and an adjustment device adjustably positioning the at least one positionable feed line to an angular position relative to the flow direction of the slurry toward the turbulence insert and the flow direction of the slurry through the distributing pipe.

13. The headbox of claim 12, further comprising a regulating device coupled to the at least one positionable feed line for adjusting a flow rate through the at least one positionable feed line.

14. The headbox of claim 12, the turbulence insert comprising a plurality of turbulence pipes arranged in a plurality of rows and columns.

15. The headbox of claim 12, the turbulence insert comprising a plurality of turbulence recesses arranged as columns, each turbulence recess comprising a plurality of turbulence pipes.

16. The headbox of claim 12, the turbulence insert further comprising a plurality of adjustable guide walls for diverting the slurry flow toward the turbulence insert.

17. A headbox for a paper machine comprising:

a turbulence insert having an inlet end;

a distributing pipe having a connecting area, the distributing pipe extending across a width of the paper machine for feeding a slurry flow through the connecting area and into the turbulence insert;

a nozzle having an outlet gap;

a plurality of feed lines supplying control flows;

the plurality of feed lines being coupled to the connecting area at an angle $\alpha$ between approximately 5° and 170° with respect to a directional component of the slurry flow directed toward the turbulence insert, the plurality of feed lines being positioned in a vicinity of the inlet end;

a device for adjusting the control flows, whereby a consistency of the slurry flow is adjusted in the vicinity of the inlet end by adjusting the control flows, while a constant volumetric flow of the slurry flow is maintained in the vicinity of the inlet end;

the plurality of feed lines being positioned at an angle $\gamma$ between approximately 5° and 90° with respect to the direction of the slurry flow into the turbulence insert and within a plane substantially parallel to a plane formed by the inlet end of the turbulence insert; and the plurality of feed lines being adjustably positionable to the angle $\gamma$.

18. A headbox for a machine comprising:

a distributing pipe extending along a width of the machine for distributing a slurry flow;

a turbulence insert having an inlet end coupled to the distributing pipe;

at least one feed line coupled to the distributing pipe;

the at least one feed line positionable at an angle less than approximately 180° with respect to a flow direction of the slurry toward the turbulence insert; and an adjustment device adjusting the at least one positionable feed line.

19. A process for adjusting a consistency of a slurry flow in a headbox for a machine having a turbulence insert, the process comprising:

guiding a slurry flow lateral to a turbulence insert;

diverting a portion of the lateral slurry flow toward the turbulence insert;

injecting a control flow at an angle less than approximately 180° with respect to the lateral slurry flow toward the turbulence insert; and guiding the lateral slurry flow and the control flow through the turbulence insert, wherein the injecting further comprises directing the control flow at an angle less than approximately 90° with respect to the slurry flow lateral to the turbulence insert, and injecting and directing the control flow in a direction opposite the lateral slurry flow.

20. The process according to claim 19, the injecting and directing further comprising:

regulating an injection rate for the control flow, whereby the control flow is guided through each turbulence pipe in the turbulence insert.

* * * * *